US005390691A

United States Patent [19]

Sproule

[11] Patent Number: 5,390,691

[45] Date of Patent: Feb. 21, 1995

[54] BLEED VALVE FOR WATER SUPPLY FOR CAMPING VEHICLE

[76] Inventor: Ronald Sproule, 113 N. Dodge St., Galena, Ill. 61036

[21] Appl. No.: 187,221

[22] Filed: Jan. 27, 1994

[51] Int. Cl.[6] ..... F16K 24/00

[52] U.S. Cl. ..... 137/1; 137/615; 137/899; 137/596

[58] Field of Search ..... 137/899, 615, 596, 1

[56] References Cited

U.S. PATENT DOCUMENTS

| | | | |
|---|---|---|---|
| 357,241 | 2/1887 | Steinkoenig | 137/596 X |
| 1,331,535 | 2/1920 | Smith | 137/596 |
| 1,945,760 | 2/1934 | Strouf | 137/596 |

*Primary Examiner*—Arnold Rosenthal
*Attorney, Agent, or Firm*—Allan L. Harms

[57] ABSTRACT

A bleed valve apparatus for the fresh water system of a camping vehicle. The apparatus is interposed between a garden hose and the female hose coupling of the plumbing system of the camping vehicle. The apparatus includes a housing which contains three ends, one of which has a mating coupling for the camping vehicle plumbing system. A second end may be coupled to the garden hose. The third end is isolated from the other ends by a water valve which may be opened to allow the apparatus to serve as an outdoor faucet at the camping vehicle or to serve to allow water to drain from the camping vehicle plumbing when the user of the camping vehicle desires to disconnect from the external water system provided through the hose. The configuration of the apparatus allows a garden hose to be routed from the camping vehicle to a water hydrant with few required bends along the hose.

13 Claims, 1 Drawing Sheet

BLEED VALVE FOR WATER SUPPLY FOR CAMPING VEHICLE

BACKGROUND OF THE INVENTION

It is commonplace for owners of camping trailers or motor homes for recreational use to attach their camping vehicles to a fresh water supply, if available, at a selected campsite. The typical camping trailer or motor home is equipped with internal plumbing connections to provide fresh water to sink fixtures, showers, hot water heaters, and other water outlets. The external connection for fresh water is typically a female hose connection of the threaded type such as is used on garden hoses. This type of fitting is provided because the common campsite hookup for fresh water is connected by a garden hose of well known variety.

When a garden hose is connected to the female water inlet coupling on the camping trailer or motor home, it is inevitable that pockets of air remain in the hose and in the internal plumbing of the camping trailer or motor home. Stale water may also remain in the supply hose. The air is forced out of the system when water pressure is provided through the garden hose but the harsh sputtering of faucets must be tolerated until the air in the system is purged. The throbbing of pipes caused by the purging air causes vibrations in the plumbing which may tend to dislodge the plumbing components from their mountings or to damage joints along the plumbing system. The camper owner typically tolerates the noise and throbbing and leaves a faucet open when the water pressure at the source begins to be applied to the system connected by the garden hose.

Because the typical camping vehicle external fresh water connection exits the camping vehicle in a horizontal configuration, the attachment of the connection to a garden hose aggravates strain on the hose due to the light bends which are required as the hose is routed to lie on the ground.

After the camping owner has finished his or her stay at a campsite, the fresh water connection between the camping trailer or motor home internal plumbing system must be removed from the water source. Though the water source may be closed by the usual valve at a hydrant, water pressure remains in the camping trailer or motor home plumbing system. Hence, when the hose connection to the camping trailer or motor home is loosened and removed, water under pressure escapes from the loosened coupling, thereby spraying the surrounding area along with the person removing the hose.

SUMMARY OF THE INVENTION

The present invention relates to camping vehicles such as camping trailers and motor homes, and in particular to the fresh water plumbing system for camping vehicles. Accordingly, an apparatus is disclosed which interconnects the external fresh water coupling of a camping vehicle to a source of fresh water supplied selectively through a flexible garden hose.

The apparatus comprises a housing having alternate passageways therethrough and having a selectively controllable water valve therealong. The housing is provided with three ends, the first of which terminates in a male coupling which is matable with a female coupling provided on a camping vehicle for attachment of a fresh water source. A second end is provided with a female garden hose coupling which may receive the male coupling of a garden hose connected to a fresh water source, such as by a campsite hydrant. The third end of the housing is provided with an adjustable spout and is joined to the valve member of the housing.

It is an object of the invention to provide a simple, inexpensive connection which allows air to be bled from a fresh water plumbing system connected to a camping vehicle.

It is another object of the invention to provide a simple connection which allows stale water in a supply hose to be diverted from the plumbing system of a camping vehicle.

It is another object of the invention to provide a valved connector to interconnect a fresh water source provided through a garden hose to the plumbing system of a camping vehicle.

It is another object of this invention to provide a device to reduce the strain on a garden hose connected to the plumbing system of a camping vehicle.

It is another object of the invention to provide a system to permit water to be drained from a camping vehicle plumbing system before removal of a fresh water source coupled with the plumbing system of the camping vehicle.

It is still a further object of the invention to provide an outside water fountain for use with a camping vehicle.

The foregoing objects and others will be recognized from examination of the detailed description which follows.

DESCRIPTION OF THE DRAWING FIGURES

DETAILED DESCRIPTION OF THE INVENTION

Figure 1:
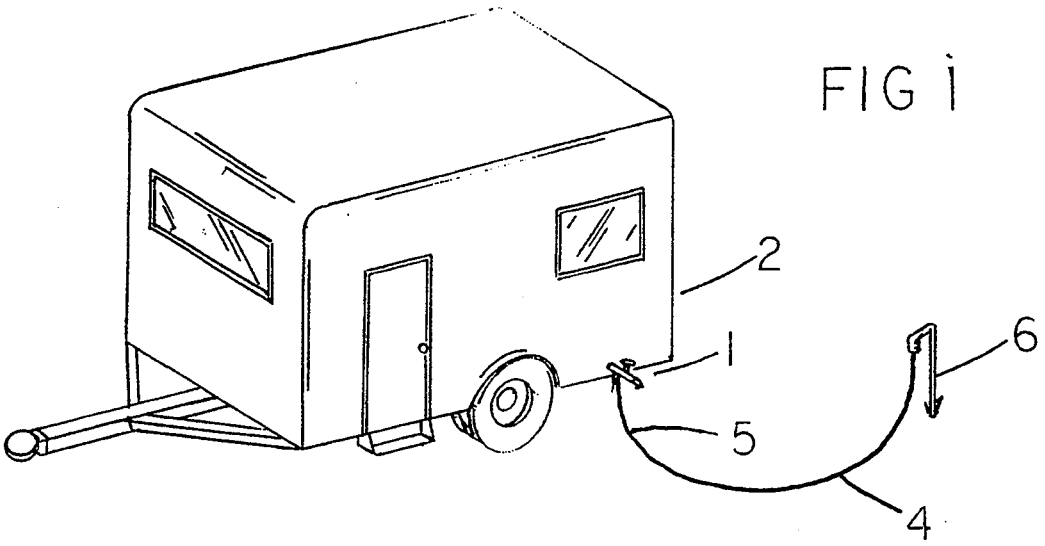
FIG. 1 is a right side perspective view of a camping vehicle provided with the preferred embodiment of the invention connected to a fresh water hydrant.

Referring to FIG. 1, a camping vehicle 2 equipped with invention 1 is shown connected to a garden hose 4 which is coupled to a fresh water hydrant 6 such as is typical at campsites equipped with water service. Fresh water is supplied at hydrant 6 and is transmitted through hose 4 and invention 1 to the internal fresh water plumbing of camping vehicle 2.

Figure 3:
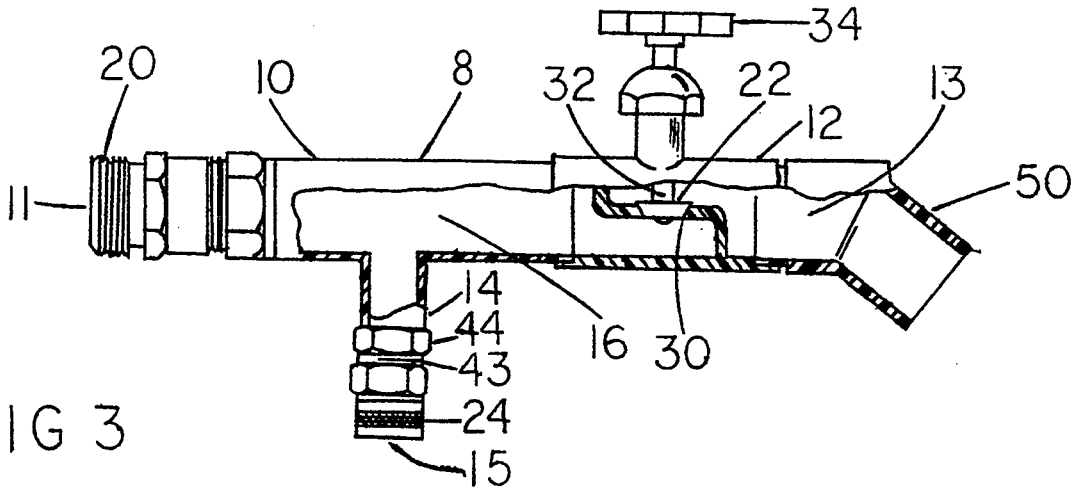
FIG. 3 is a front elevation of the invention with parts of the housing cut away to show interior features.

The invention 1, as shown in an enlarged front elevation in FIG. 3, is provided with housing 8 having first end 10, second end 12, and third end 14. Housing 8 is provided with internal passageway 16 which is communicative with bores 11, 13, and 15 of first end 10, second end 12, and third end 14 respectively. First end 10 of housing 8 is provided with coupling 20 which is suitable for mating attachment to the external fresh water inlet coupling provided on camping vehicle 2. Typically coupling 20 is a male garden hose coupling since the typical method for providing fresh water to a properly equipped camping vehicle is by coupling the male end of a garden hose to the external fresh water inlet of the camping vehicle.

Third end 14 of housing 8 terminates in a female garden hose coupling 24 which is provided for attachment to a garden hose provided for interconnection to a fresh water source such as is illustrated by hydrant 6 and hose 4 of FIG. 1. Second end 12 is provided with a valve 22 comprising a seat 30, plunger 32 and handle 34, such that when plunger 32 is lowered into abutment against seat 30 by turning of handle 34, passageway 16 is obstructed within second end 12. When valve 22 is opened, it can be seen that bore 13 of second end 12 is communicative with passageway 16 of housing 8.

When invention 1 is coupled at first end 10 to the fresh water inlet coupling of camping vehicle 2, third end 14 may be coupled to a garden hose 4 which is coupled to a fresh water source. Valve 22 is placed in its closed position and water may be allowed to flow into camping vehicle 2 from hose 4 through passageway 16 of invention 1. If a supply of water is desired at the outside of camping vehicle 2, valve 22 may be opened and invention 1 then serves as an exterior faucet.

It may be understood from the illustration of FIG. 1 that hose 4 suffers less arching strain when used with invention 1 than when directly connected to the camping vehicle because the bend 5 in hose 4 is the only bend which occurs near the connection of hose 4 to invention 1.

Figure 2:
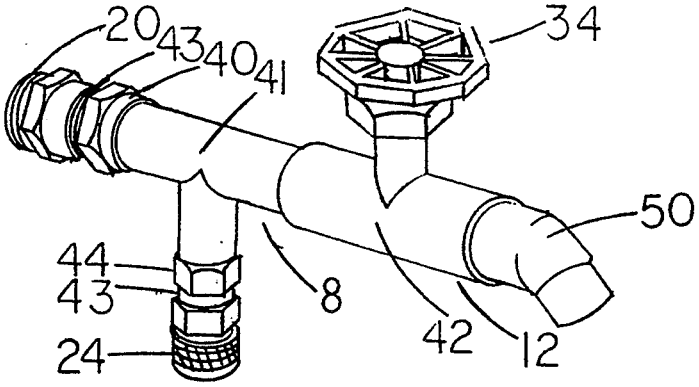
FIG. 2 is a perspective view of the invention with the optional spout member mounted thereto.

FIGS. 2 and 3 illustrate the invention with a directional spout 50 mounted to second end 12. Spout 50 is rotatably mounted to housing 8 such that spout 50 may be turned upward to serve as a water fountain or downward to be useful in filling a receptacle. The issue may thereby serve as an external water faucet for the camping vehicle.

When the time arrives to leave the campsite, the water hydrant 6 is closed but water remains under pressure in hose 4, in invention 1, and in the plumbing of camping vehicle 2. Valve 22 may then be opened and the water pressure relieved and water drained from the internal plumbing of the camping vehicle 2 in a controlled fashion.

In FIG. 2, it can be seen that invention 1 may be simply constructed of readily available standard plumbing parts, including a plumbing tee 41 which is mounted to a first axial extension 40 and to second axial extension 44 at two of its ends and to valve body 42 at its third end. Each of extensions 40 and 44 is adhesively mounted in axial fashion to tee 41 and each contains external threading 43. Male hose coupling 20 is screw mounted to first extension 40 and female hose coupling 24 is mounted to second extension 44. Valve 22 is provided within valve body 42. In the preferred embodiment, the plumbing tee 41, the extensions 40 and 44, and the valve body 42 are plastic parts. Male coupling 20 and female coupling 24 are made from brass or other metal, though plastic parts may be substituted for these brass couplings. Spout 50 is also preferably a plastic standard plumbing item and is frictionally mounted to valve body 42 to allow it to be manually rotated upon housing 8.

The use of ordinary plumbing parts makes invention 1 simple and inexpensive to fabricate. It is to be understood that other materials and methods of fabrication may be employed without departing from the invention.

Having disclosed the invention, I claim

1. A method for draining water from the fresh water plumbing system of a camping vehicle connected by a garden hose to a fresh water supply from a hydrant, comprising interposing a valved coupling between said garden hose and the fresh water plumbing system of the camping vehicle, closing the hydrant, opening the valve of said housing, the valved coupling comprising a housing having at least three ends and a passageway therethrough, said housing having a selectively controlled valve therealong, one of said ends matable with the external fresh water coupling of the camping vehicle, a second of said ends having a coupling thereon, said valve operable to isolate the third of said ends from said passageway.

2. Apparatus for a camping vehicle equipped with an external fresh water coupling, comprising a housing having at least three ends and a passageway therethrough, said housing having a selectively controlled valve therealong, one of said ends matable with the external fresh water coupling of the camping vehicle, a second of said ends having a coupling thereon, said valve operable to isolate the third of said ends from said passageway, said third end of said housing is provided with a spout member thereon, said spout member may be selectively rotated relative to said housing.

3. The apparatus of claim 2 wherein said valve is a manually operated plunger valve, said one of said ends terminates in a male garden hose coupling, said coupling of said second end is a female hose coupling.

4. Apparatus for a camping vehicle equipped with an external fresh water coupling, comprising a housing having at least three ends and a passageway therethrough, said housing having a selectively controlled valve therealong, one of said ends matable with the external fresh water coupling of the camping vehicle, a second of said ends having a coupling thereon, said valve operable to isolate the third of said ends from said passageway, said housing comprises a plumbing tee having three ends, a first of said ends of said tee having an axial extension thereon, a second of said ends having an axial extension thereon, said axial extension of said second end having a female hose coupling mounted thereto, the third of said ends having a plumbing valve body mounted thereto, said plumbing valve body containing said valve therein.

5. The apparatus of claim 4 wherein said tee, said extension, and said valve body are standard plastic plumbing parts.

6. The apparatus of claim 2 wherein said valve is a manually operated plunger valve.

7. The apparatus of claim 2 wherein said one of said ends terminates in a male garden hose coupling.

8. The apparatus of claim 2 wherein said coupling of said second end is a female hose coupling.

9. A coupling for interconnecting the external fresh water coupling of a camping vehicle to a garden hose connected to a fresh water supply, comprising a housing having at least three ends and a passageway therethrough, said housing having a selectively controlled valve therealong, one of said ends matable with the external fresh water coupling of the camping vehicle, a second of said ends interconnectable with said garden hose, said valve operable to isolate the third of said ends from said passageway, said third of said ends having an elongate axial passageway therethrough.

10. The coupling of claim 9 wherein said one of said ends terminates in a male garden hose coupling, said second end terminates in a female hose coupling.

11. The coupling of claim 9 wherein said third end of said housing is provided with a spout member thereon.

12. The coupling of claim 9 wherein said housing comprises a plumbing tee having three ends, said first of said ends of said tee having a male garden hose coupling thereon, said second of said ends of said tee having a female hose coupling mounted thereto, the third of said ends of said tee having a plumbing valve body mounted thereto, said plumbing valve body containing said valve therein.

13. The apparatus of claim 9 wherein said spout member may be selectively rotated relative to said housing.

* * * * *